US009548544B2

(12) United States Patent
Watson et al.

(10) Patent No.: US 9,548,544 B2
(45) Date of Patent: Jan. 17, 2017

(54) ANTENNA ELEMENT FOR SIGNALS WITH THREE POLARIZATIONS

(71) Applicant: Huawei Technologies Co., Ltd., Shenzhen (CN)

(72) Inventors: Paul Robert Watson, Kanata (CA); Halim Boutayeb, Montreal (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 5 days.

(21) Appl. No.: 14/745,421

(22) Filed: Jun. 20, 2015

(65) Prior Publication Data

US 2016/0372839 A1 Dec. 22, 2016

(51) Int. Cl.

| | |
|---|---|
| ***H01Q 21/00*** | (2006.01) |
| ***H01Q 21/26*** | (2006.01) |
| ***H01Q 19/10*** | (2006.01) |
| ***H01Q 21/24*** | (2006.01) |
| *H01Q 1/12* | (2006.01) |
| *H01Q 9/16* | (2006.01) |
| *H01Q 9/28* | (2006.01) |
| *H01Q 21/28* | (2006.01) |
| *H01Q 3/26* | (2006.01) |
| *H01Q 5/00* | (2015.01) |
| *H01Q 21/06* | (2006.01) |

(52) U.S. Cl.

CPC ..... *H01Q 21/26* (2013.01); *H01Q 19/108* (2013.01); *H01Q 21/24* (2013.01); *H01Q 1/1271* (2013.01); *H01Q 3/26* (2013.01); *H01Q 5/00* (2013.01); *H01Q 9/16* (2013.01); *H01Q 9/285* (2013.01); *H01Q 21/062* (2013.01); *H01Q 21/28* (2013.01)

(58) Field of Classification Search

CPC ..... H01Q 21/28; H01Q 5/00; H01Q 1/1271; H01Q 9/16; H01Q 9/285; H01Q 21/062; H01Q 3/26

USPC ... 343/727, 722, 795, 793, 713, 853; 33/816

See application file for complete search history.

(56) References Cited

U.S. PATENT DOCUMENTS

| | | | | |
|---|---|---|---|---|
| 2004/0183739 | A1* | 9/2004 | Bisiules | H01P 5/103 343/795 |
| 2009/0096699 | A1 | 4/2009 | Chiu et al. | |
| 2012/0169552 | A1 | 7/2012 | Lee et al. | |

FOREIGN PATENT DOCUMENTS

| | | |
|---|---|---|
| CN | 201307640 | 9/2009 |
| CN | 101884183 A | 11/2010 |
| CN | 104009277 A | 8/2014 |

OTHER PUBLICATIONS

Chiu et al., "24-Port and 36-Port Antenna Cubes Suitable for MIMO Wireless Communications", IEEE Transactions on Antennas and Propagation, vol. 56, No. 4, Apr. 2008, 7 pages.

* cited by examiner

*Primary Examiner* — Joseph Lauture
(74) *Attorney, Agent, or Firm* — Slater Matsil, LLP

(57) ABSTRACT

An antenna element for signals with three polarizations and the method for operating such an antenna element are disclosed. In an embodiment the antenna element includes a first dipole element configured to emit or receive electromagnetic signals in a first polarization direction, a second dipole element configured to emit or receive electromagnetic signals in a second polarization direction, a monopole element configured to emit or receive electromagnetic signals in a third polarization direction and an antenna reflector element, wherein the first dipole element, the second dipole element and the monopole element are collocated on the antenna reflector element, and wherein the first polarization direction, the second polarization direction and the third polarization direction are all different.

21 Claims, 13 Drawing Sheets

ANTENNA ELEMENT FOR SIGNALS WITH THREE POLARIZATIONS

TECHNICAL FIELD

The present invention relates a compact antenna element for signals with three polarization directions and a method for operating such an antenna element.

BACKGROUND

Base station antennas are often mounted in high traffic metropolitan areas. As a result, compact antenna modules are favored over bulkier ones because compact modules are aesthetically pleasing (e.g., less-noticeable) as well as easier to install and service. Many base station antennas deploy arrays of antenna elements to achieve advanced antenna functionality, e.g., beamforming, etc. Accordingly, techniques and architectures for reducing the profile of an individual antenna element as well as for reducing the size (e.g., width, etc.) of the antenna element arrays are desired.

SUMMARY

In accordance with an embodiment of the present invention, an antenna element comprises a first dipole element configured to emit or receive electromagnetic signals in a first polarization direction, a second dipole element configured to emit or receive electromagnetic signals in a second polarization direction, and a monopole element configured to emit or receive electromagnetic signals in a third polarization direction. The antenna element further comprises an antenna reflector element, wherein the first dipole element, the second dipole element and the monopole element are collocated on the antenna reflector element, and wherein the first polarization direction, the second polarization direction and the third polarization direction are all different.

In accordance with an embodiment of the present invention, a method for communicating an electromagnetic signal comprises receiving or emitting, by a monopole element, a first electromagnetic signal component in a first polarization direction, receiving or emitting, by a first dipole monopole element, a second electromagnetic signal component in a second polarization direction and receiving or emitting, by a second dipole element, a third electromagnetic signal component in a third polarization direction, wherein the first dipole element, the second dipole element and the monopole element are collocated on an antenna reflector element, and wherein the first polarization direction, the second polarization direction and the third polarization direction are all different.

In accordance with an embodiment of the present invention, an antenna element comprises an antenna reflector element, a monopole element disposed on the antenna reflector element in a first direction, a first dipole element disposed on the antenna reflector element in a second direction and a second dipole element disposed on the antenna reflector element in a third direction, wherein the second direction is arranged in about a +45° angle to the first direction, wherein the third direction is arranged in about a −45° angle to the first direction, and wherein the monopole element, the first dipole element and the second dipole element are arranged around a central axis, the central axis being orthogonal to the antenna reflector element.

In accordance with an embodiment of the present invention, a method for communicating an electromagnetic signal from and to an antenna element is disclosed. The antenna element comprises an antenna reflector element, a monopole element disposed on the antenna reflector element in a first direction, a first dipole element disposed on the antenna reflector element in a second direction and a second dipole element disposed on the antenna reflector element in a third direction, wherein the second direction is arranged in about a +45° angle to the first direction, wherein the third direction is arranged in about a −45° angle to the first direction, and wherein the monopole element, the first dipole element and the second dipole element are arranged around a central axis, the central axis being orthogonal to the antenna reflector element. The method comprises receiving or emitting, by the monopole element, a first electromagnetic signal component, receiving or emitting, by the first dipole element, a second electromagnetic signal component and receiving or emitting, by a second dipole element, a third electromagnetic signal component.

In accordance with an embodiment of the present invention, a system includes an antenna element comprising a first dipole element configured to emit or receive electromagnetic signals in a first polarization direction, a second dipole element configured to emit or receive electromagnetic signals in a second polarization direction, a monopole element configured to emit or receive electromagnetic signals in a third polarization direction, and an antenna reflector element, wherein the first dipole element, the second dipole element and the monopole element are collocated on the antenna reflector element, and wherein the first polarization direction, the second polarization direction and the third polarization direction are all different.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

System operators require more and more capacity for multiple input and multiple output (MIMO) antennas. One way to increase the capacity of such a system is to provide an antenna with three orthogonal polarizations directions.

Embodiments provide a compact antenna element having three orthogonal polarization directions. Embodiments further provide an antenna element with three independent input ports. The antenna element may comprise three collocated elements, e.g., two dipole elements and a monopole element. The first dipole element may be rotated by an angle of 45° relative to the monopole element and the second dipole element may be rotated by an angle of −45° relative to the monopole element. The monopole element and the entire compact antenna element may comprise a height of about λ/6. In some embodiments the compact antenna element comprises cross dipoles collocated with a folded monopole wherein each of the cross dipoles includes a miniaturized balun. In further embodiments a method for operating the compact antenna element is described.

Embodiments of the invention include the advantage to increase the capacity of a MIMO antenna element, to efficiently use the available real estate and space, and to reduce the size of the antenna element. A further advantage is that such a compact antenna element can detect any electromagnetic signal.

Figure 5A:
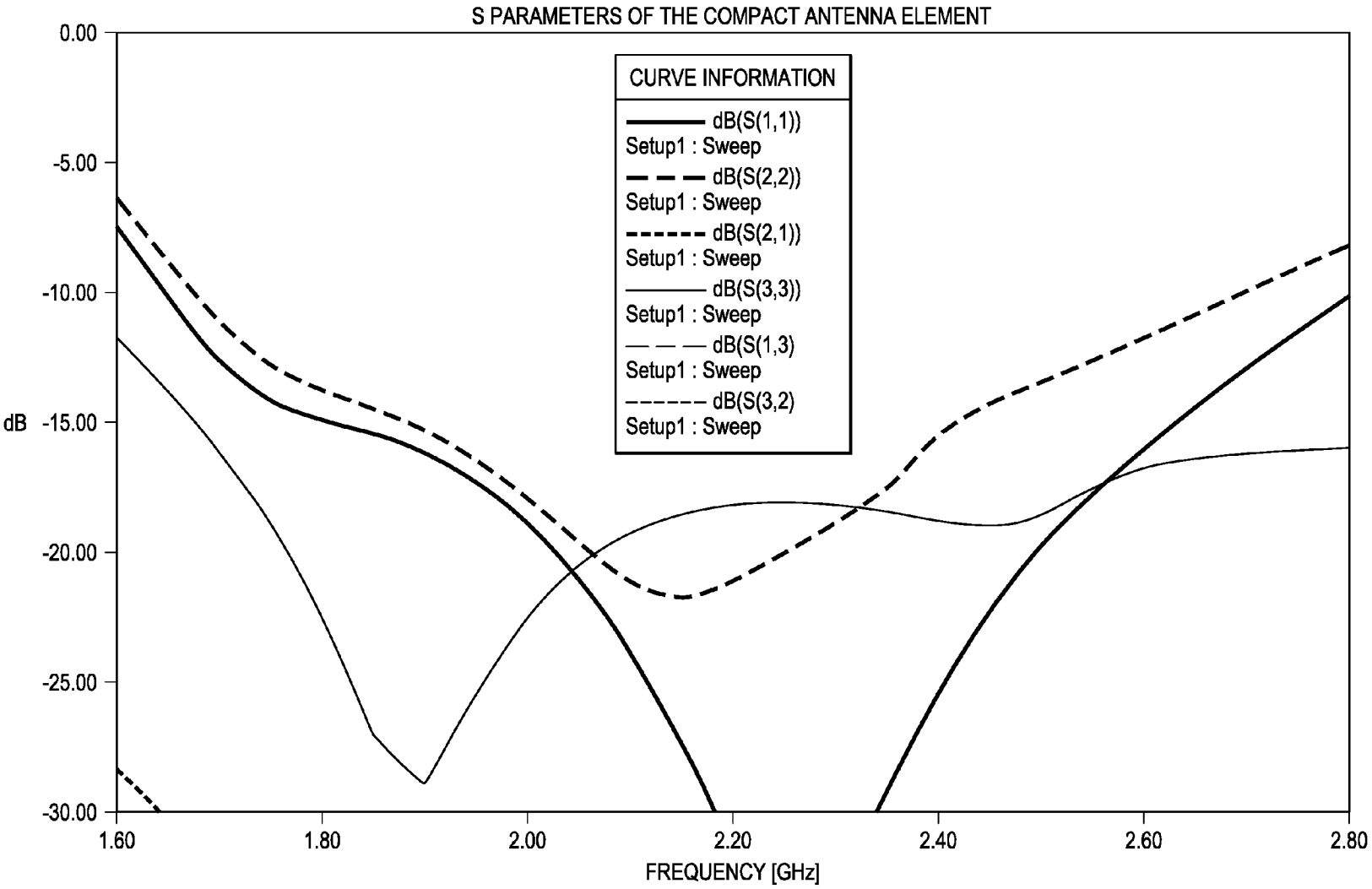
FIGS. 5*a*-5*d* show plots of electrical performances of the compact antenna element.
Figure 5B:
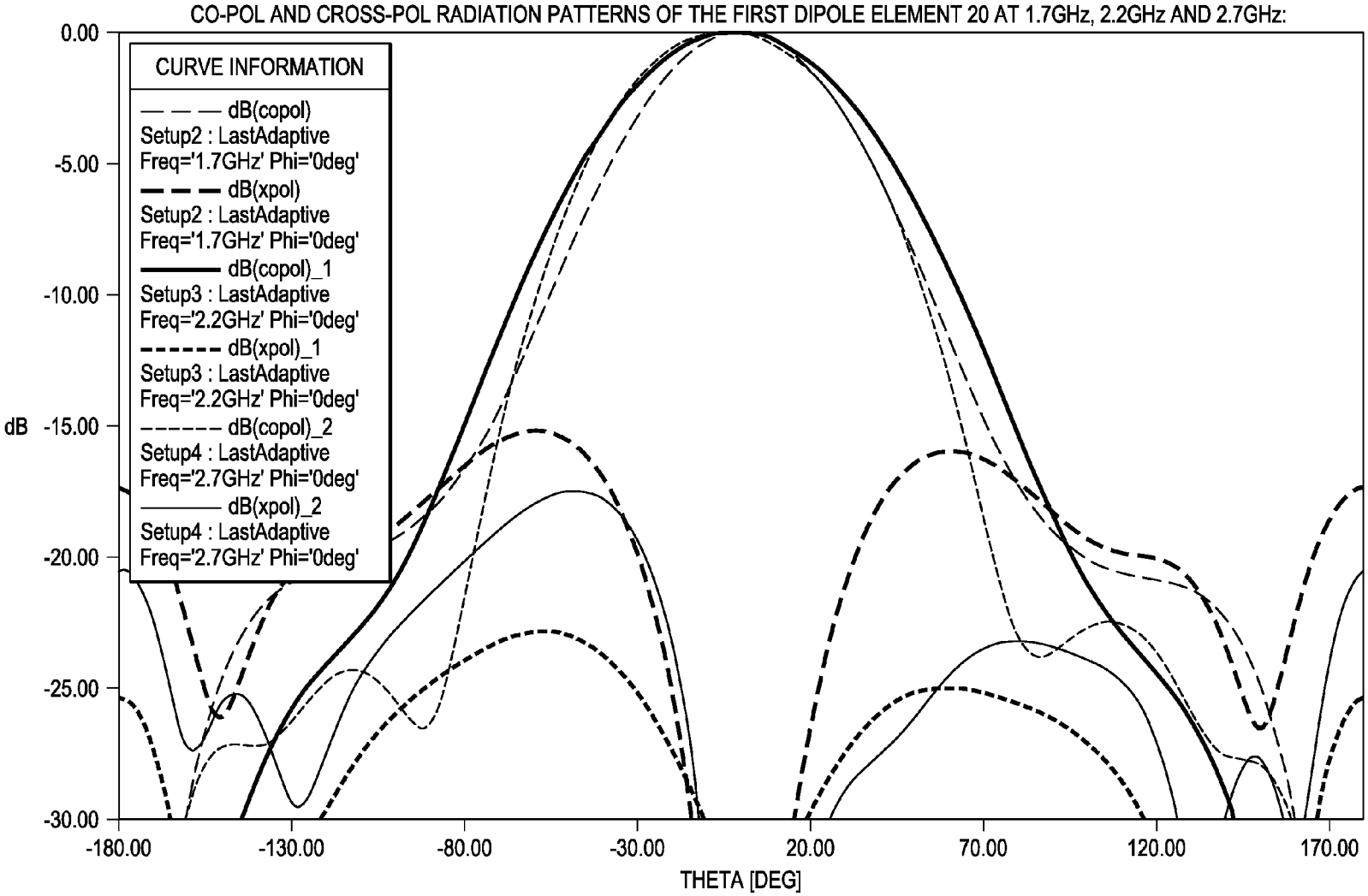
Figure 5C:
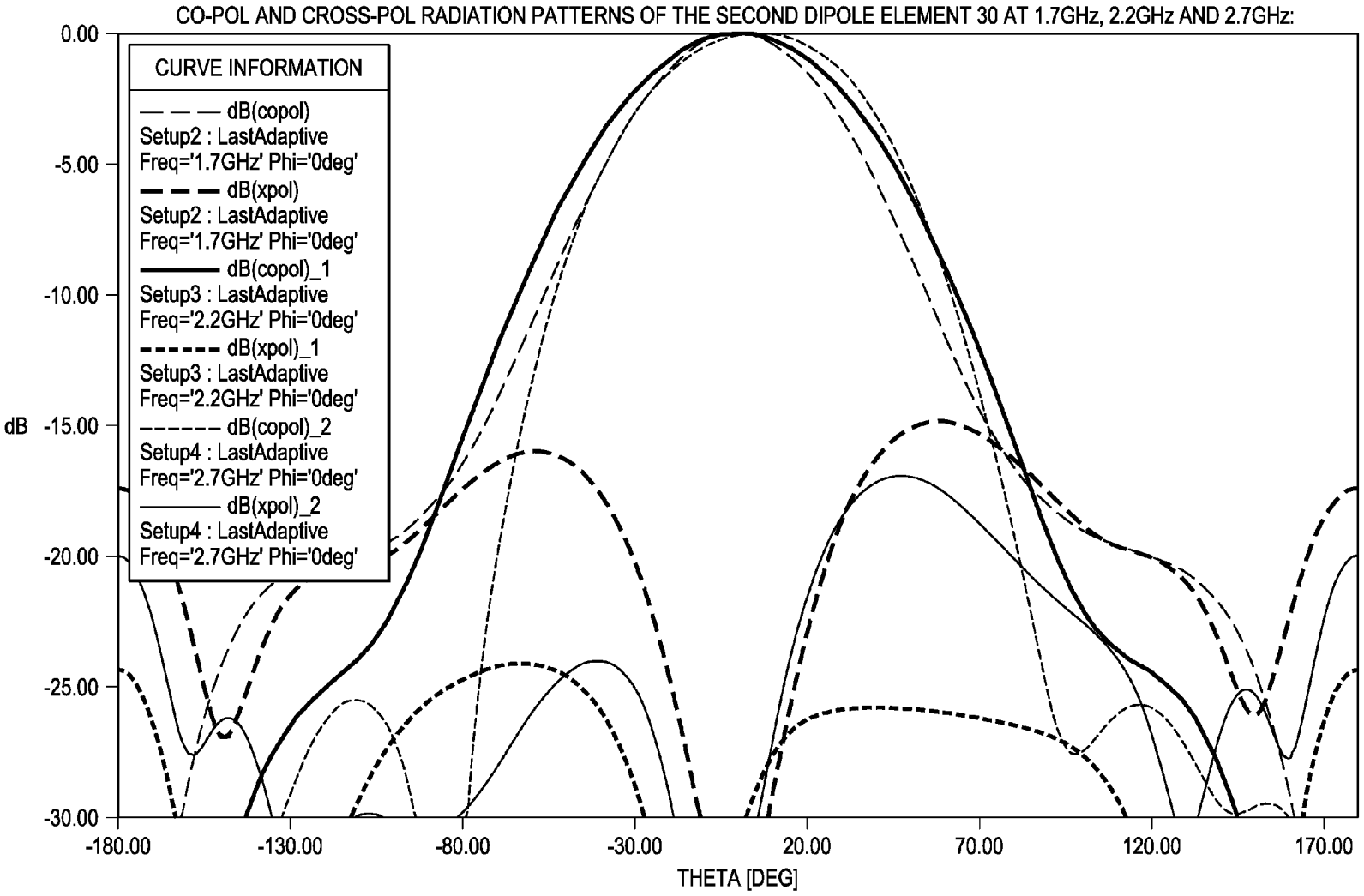
Figure 5D:
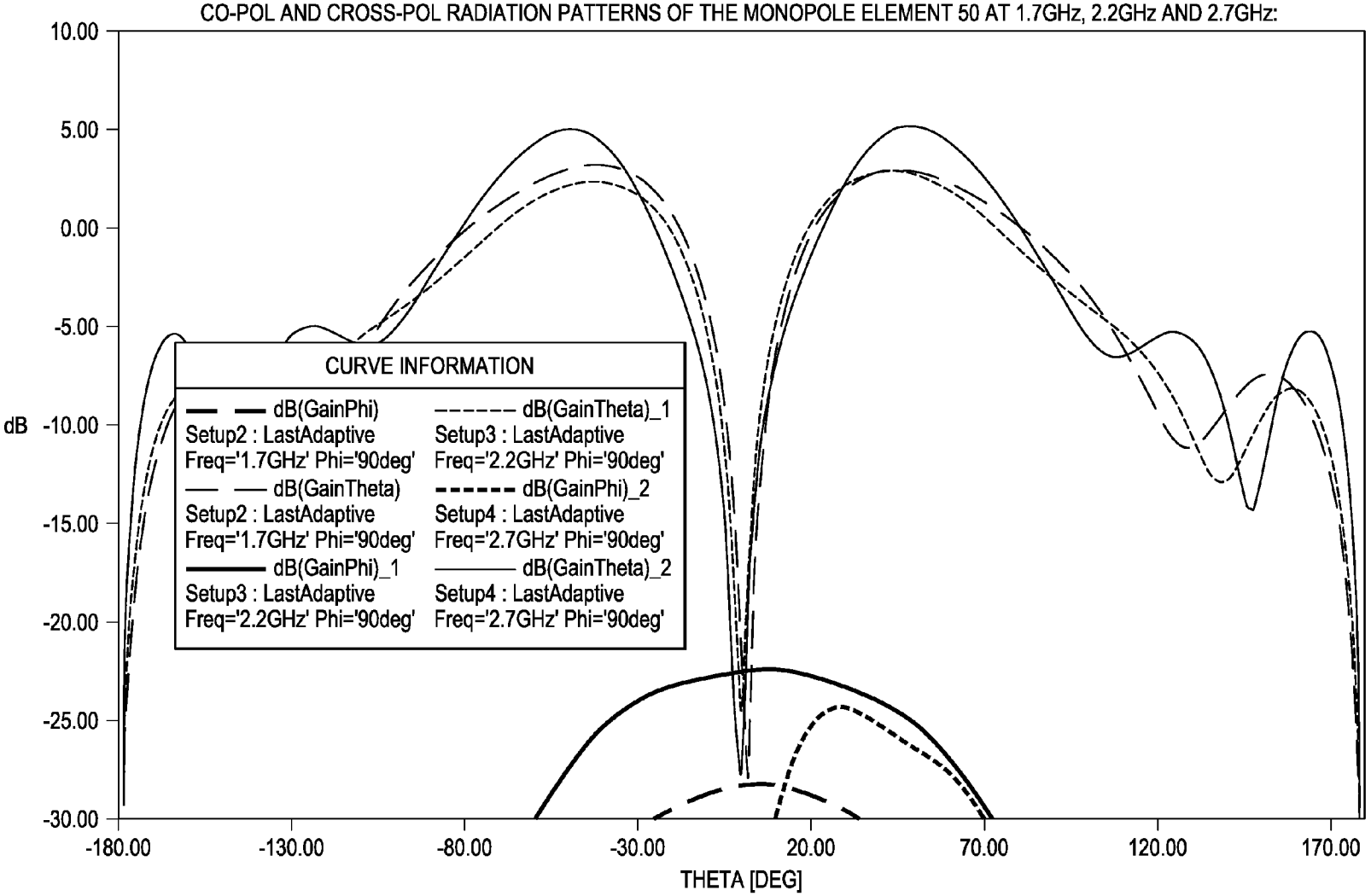

It is noted that the performance of the compact antenna element 10, as discussed in detail with respect to FIGS. 5*a*-5*d*, is surprisingly better when the elements 20, 30 and 50 are located closer to each other than further away. These three independent antenna elements are co-located with almost complete symmetry around the central axis (C-axis). The symmetry may be key to obtaining high isolation between the three co-located elements. In this implementation, the port-to port isolation is better than 30 dB, as shown in FIG. 5*a*, and cross pole discrimination (polarization purity) is excellent, as shown in FIGS. 5*b*-5*d*.

Figure 1A:
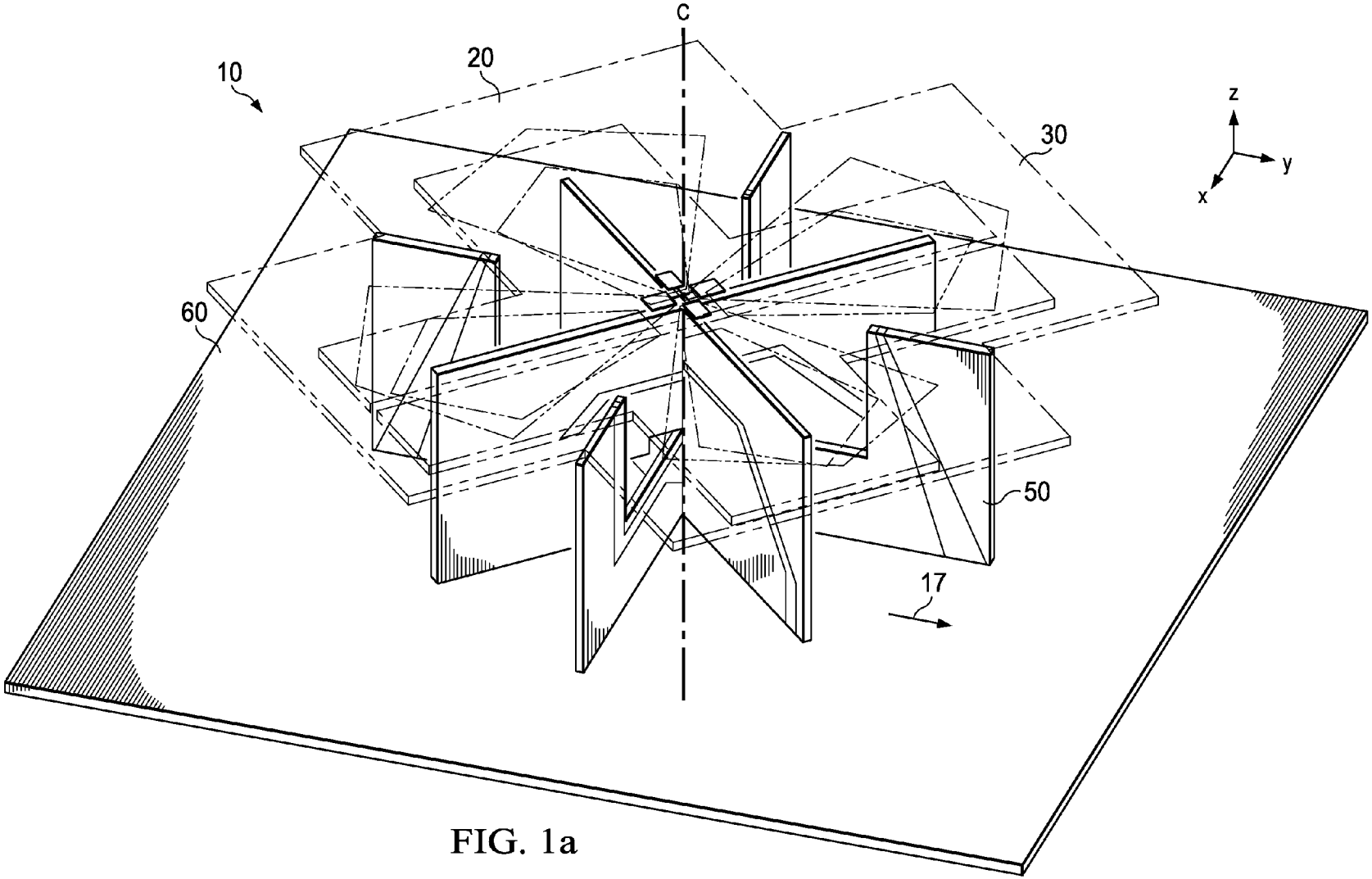
FIG. 1*a* shows a compact antenna element with three orthogonal polarizations according to an embodiment.
Figure 1B:
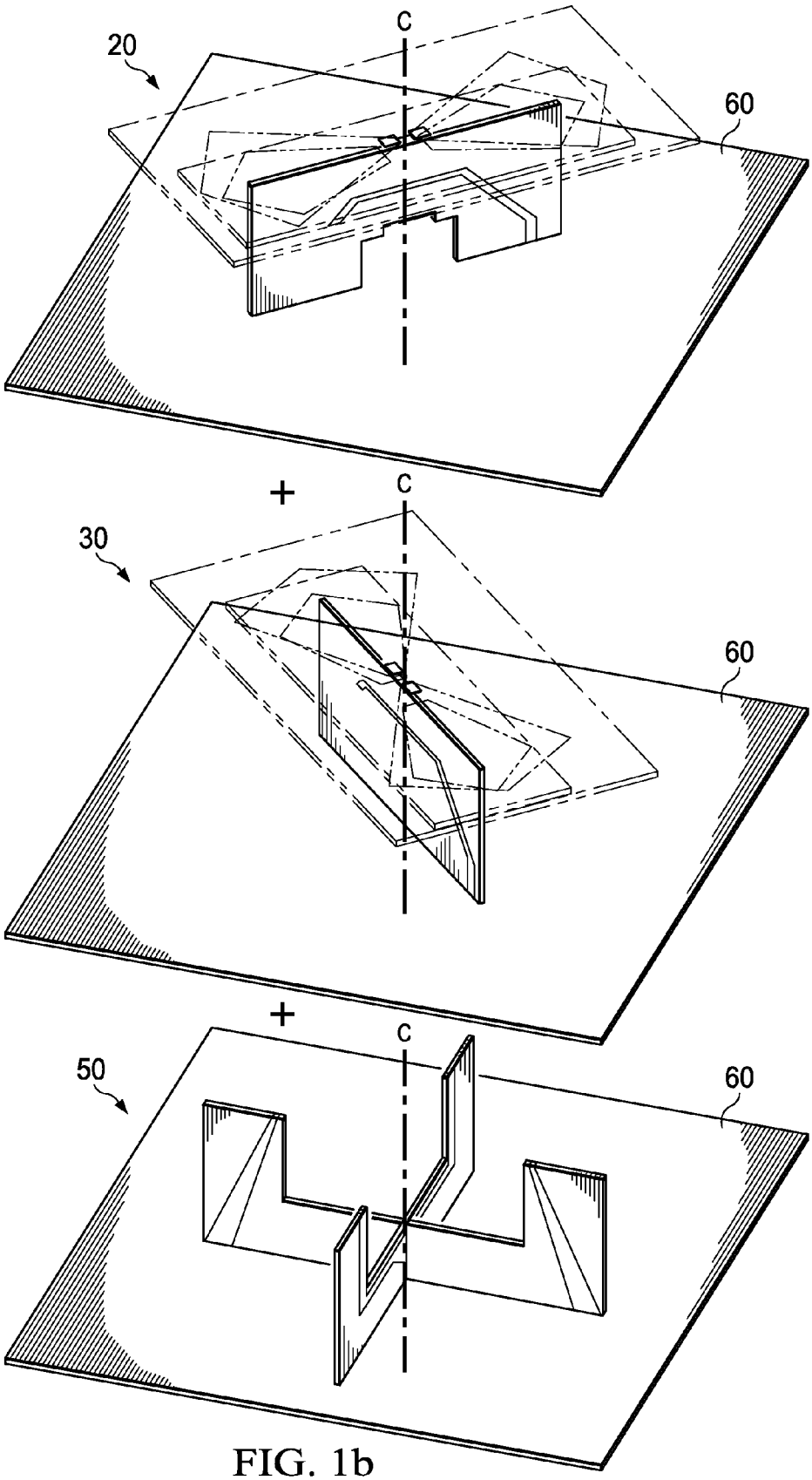
FIG. 1*b* shows how the compact antenna element is composed according to an embodiment.

FIGS. 1*a*-1*b* illustrate a compact antenna element with three orthogonal polarizations 10. The compact antenna element 10 is composed of four individual elements, two dipole elements 20, 30, a monopole element 50 and an antenna reflector element 60. The first dipole element 20 may be configured to receive or emit an electromagnetic signal in a first polarization direction, the second dipole element 30 may be configured to receive or emit an electromagnetic signal in a second polarization direction, and the monopole element 50 may be configured to receive or emit an electromagnetic signal in a third polarization direction. In some embodiments dipole element 20 is +45° or about +45° polarized dipole element, dipole element 30 is a −45° or about −45° polarized dipole element and monopole element 50 is a vertical polarized monopole element. About 45° means 45°+/−5% or 2%.

In some embodiments the two dipole elements 20, 30 are each rotated by about 45° relative to a main direction M of the monopole element 50. The two polarized dipole elements 20, 30 are rotated relative to each other by 90°. The compact antenna element 10 is disposed on a reflector element 60 (e.g., antenna horizontal reflector; ground). The height h (in z-direction) of the compact antenna element 10 is about λ/6.5 wherein λ is the wavelength of the electromagnetic signal. About λ/6.5 means λ/6.5+/−10%, or alternatively, λ/6.5+/−5%, or even λ/6.5+/−2%. The length l (in x-direction) of the compact antenna element 10 is about λ/2 and the width w (in y-direction) of the compact antenna element 10 is about λ/2. In some embodiments, the compact antenna element 10 is symmetric around a central axis. About λ/2 means λ/2+/−10%, or alternatively, λ/2+/−5%, or even λ/2+/−2%. The total length, end to end, of the upper dipole probe is approximately λ/2 near the lower end of the frequency band while the total length, end to end, of the smaller, lower dipole probe is approximately λ/2 near the upper end of the frequency band in some embodiments.

FIG. 1*b* discloses how the dipole elements 20, 30 and the monopole element 50 are collocated to form the compact antenna element 10. These elements 20, 30 and 50 may be disposed on a common antenna reflector element 60 such that they are located around a central axis, the C-axis. The C-axis may be defined as leading through a central point of the antenna reflector element 60 and being orthogonal to the antenna reflector element 60. These elements 20, 30 and 50 may be collocated such that they are symmetrically arranged around the C-axis (see FIG. 1*a*).

All dipole elements 20, 30 and the monopole element 50 may comprise dielectric substrates. Each dielectric substrate is generally a thin film substrate having a thickness thinner than, in most cases, around 600 μm, or thinner than around 500 μm, although thicker substrate structures are technically possible. The thin film substrate comprises an electrically insulating material, e.g., a dielectric material, with or without conductive layers. The substrate may comprise a laminate. The thin film substrate does not include a semiconductor material in some embodiments. Typical thin film substrate materials may be flexible printed circuit board materials such as polyimide foils, polyethylene naphthalate (PEN) foils, polyethylene foils, polyethylene terephthalate (PET) foils, and liquid crystal polymer (LCP) foils. Further substrate materials include polytetrafluoroethylene (PTFE) and other fluorinated polymers, such as perfluoroalkoxy (PFA) and fluorinated ethylene propylene (FEP), Cytop® (amorphous fluorocarbon polymer), and HyRelex materials available from Taconic. In some embodiments the substrates are a multi-dielectric layer substrate.

Figure 2A:
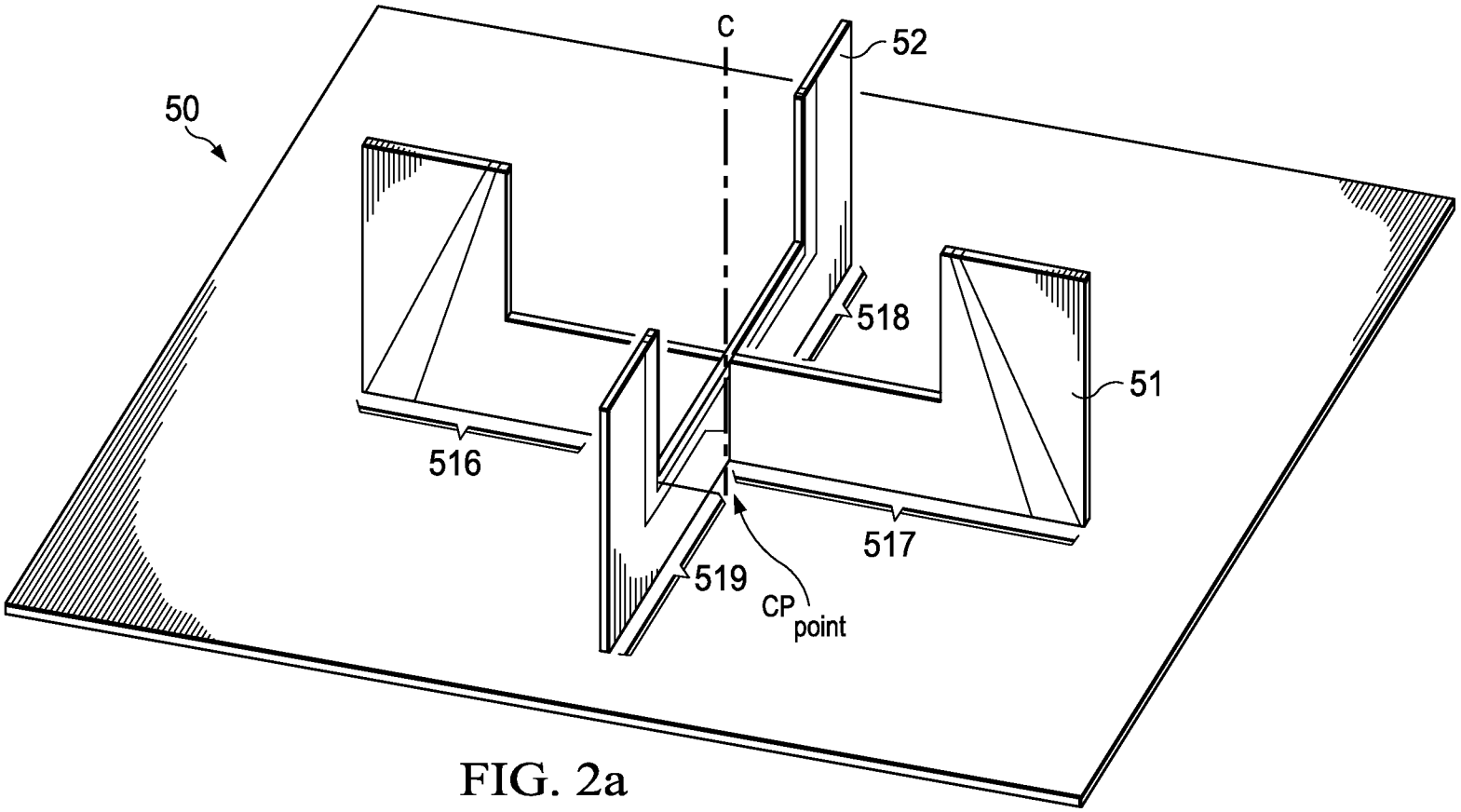
FIG. 2*a* shows a three dimensional view of a monopole antenna element according to an embodiment.
Figure 2C:
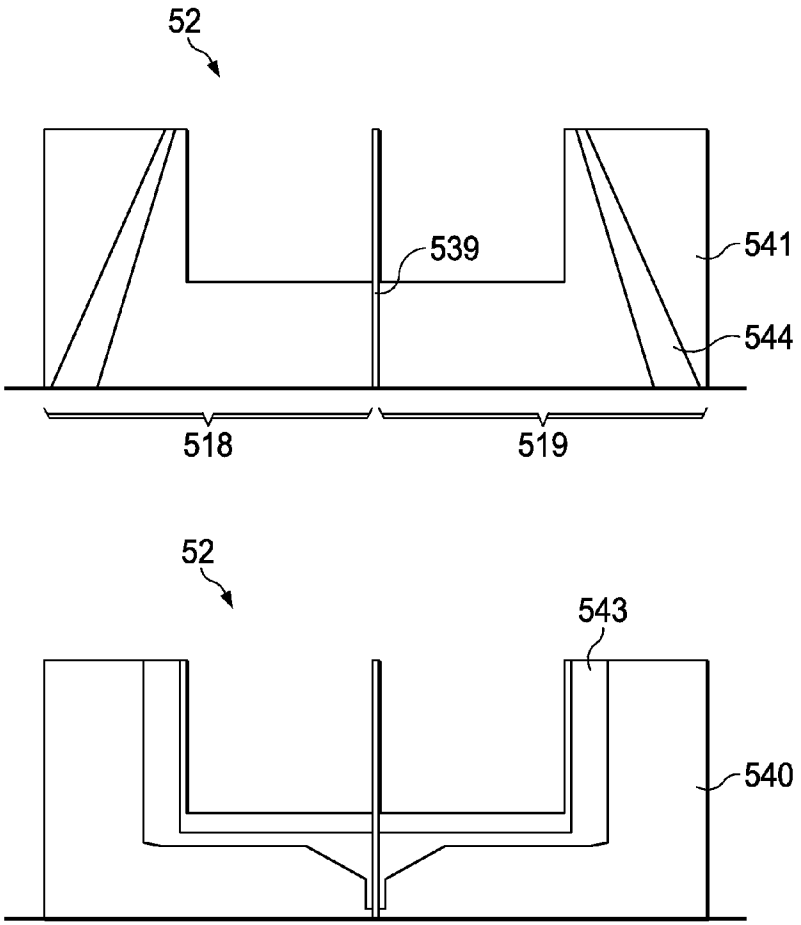
FIG. 2*c* shows a second dielectric substrate of the monopole element according to an embodiment
Figure 2B:
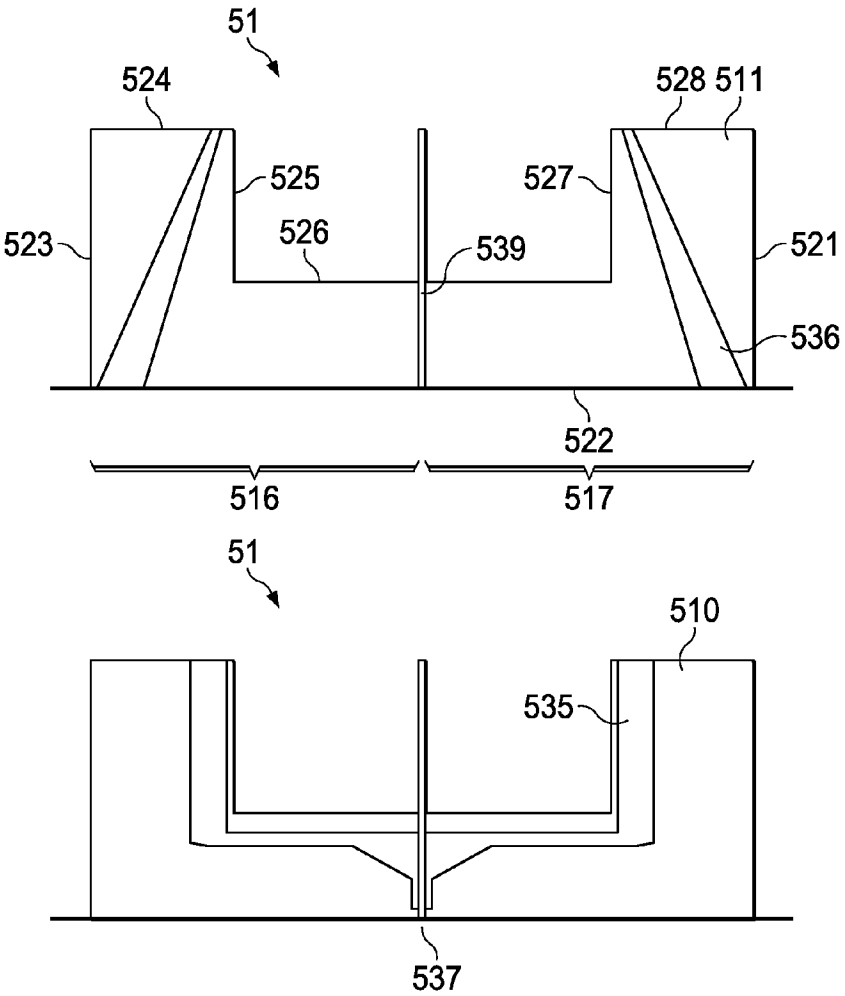
FIG. 2*b* shows a first dielectric substrate of the monopole element according to an embodiment.

As disclosed in FIGS. 2*a*-2*c*, the monopole element 50 may be a folded monopole element. The folded monopole 50 may be composed of two dielectric substrates 51, 52. The substrates 51, 52 are disposed on the antenna reflector element 60. The substrates 51, 52 may be connected such that they form a cross or an X on the antenna reflector element 60 and may be arranged orthogonal with respect to each other. The arrangement 51, 52 may be symmetric around the central C-axis running through the central point CP. The length of each side or wing 516-519 of each dielectric substrate 51, 52 may be the same when measured from the central point CP.

FIG. 2*b* shows a dielectric substrate 51 comprising a first main surface 510 and a second main surface 511, the second main surface 511 being opposite to the first main surface 510. The first and second main surfaces 510, 511 are connected via side surfaces 521-528. The side surface 522 is mechanically connected to the antenna reflector element 60. The substrate 51 may form a U wherein the horizontal side surface 526 is longer than the vertical side surfaces 525, 527 in some embodiments. In other embodiments the substrate 51 may have a different form such as a V shape or other similar shapes. In some embodiments the monopole 50 can be made only of metal without the dielectric substrate.

A first conductive layer pattern (e.g., metal pattern) 535 may be printed on the first main surface 510 of the substrate 51 and a second conductive layer pattern (e.g., metal pattern) 536 may be printed on the second main surface of the substrate 511. The first pattern 535 may be electrically connected to the second pattern 536 through edge plating (e.g., electrical connection disposed on the side surface 527, 528 or on both of these surfaces 527 and 528) or a through via. Other than this connection the two patterns 535, 536 are isolated through the substrate material of the dielectric substrate 51. The first pattern 535 connects a feed point 537 to the second pattern 536 by a vertical conductive line that then mirrors the inner shape of the substrate 51, e.g., forms an U. The second pattern 536, connected to the first pattern 535 through the edge connection or a through via, routes the conductive line diagonally down to the side surface 522. The pattern 536 may be routed diagonally down from the top of the U to the corner formed by side surfaces 521/522. The pattern 535 and 536 may comprise copper, copper alloy, aluminum, aluminum alloy, or combinations thereof. The pattern 536 at the corner of the side surfaces 521/522 may be electrically connected to the antenna reflector element 60. In contrast, the feed point 537 may be electrically isolated from the antenna reflector element 60. The substrate 51 may have a recess such that the second substrate 52 can be placed into this recess.

The substrate 51 may comprise a length of about 2λ/5 and a height h of about λ/6, wherein λ is the wavelength of the electromagnetic signal. About 2λ/5 means 5λ/5+/−10%, or alternatively, 2λ/5+/−5%, or even 2λ/5+/−2%.

FIG. 2*c* shows a side view of the substrate 52 with a first main surface 540 and a second main surface 541. The substrate 52 may be the same as the substrate 51 and may comprise the same features as described with respect to substrate 51. However, substrate 52 may not have a feed point at all and therefore also no feed point 537.

Returning to FIG. 2*a*, each of the substrate s 51, 52 may have a recess, groove or slit having a width equal to the width of the respective other substrate 51, 52 such that two substrates 51, 52 can be mechanically connected or placed together as shown in FIG. 2*a*. The conductive layer pattern 543, 544 of the second substrate 52 may be connected to the conductive layer pattern 535, 536 of the substrate 51 via a through via or an electrical solder connection at point 539.

FIGS. 3*a*-3*e* show several different views of the dipole elements 20, 30. With respect to FIGS. 3*a*-3*e* only the dipole element 20 is described since the dipole element 30 is identical to the dipole element 20. In some embodiments, however, the dipole element 30 may be different compared to the dipole element 20.

Figure 3A:
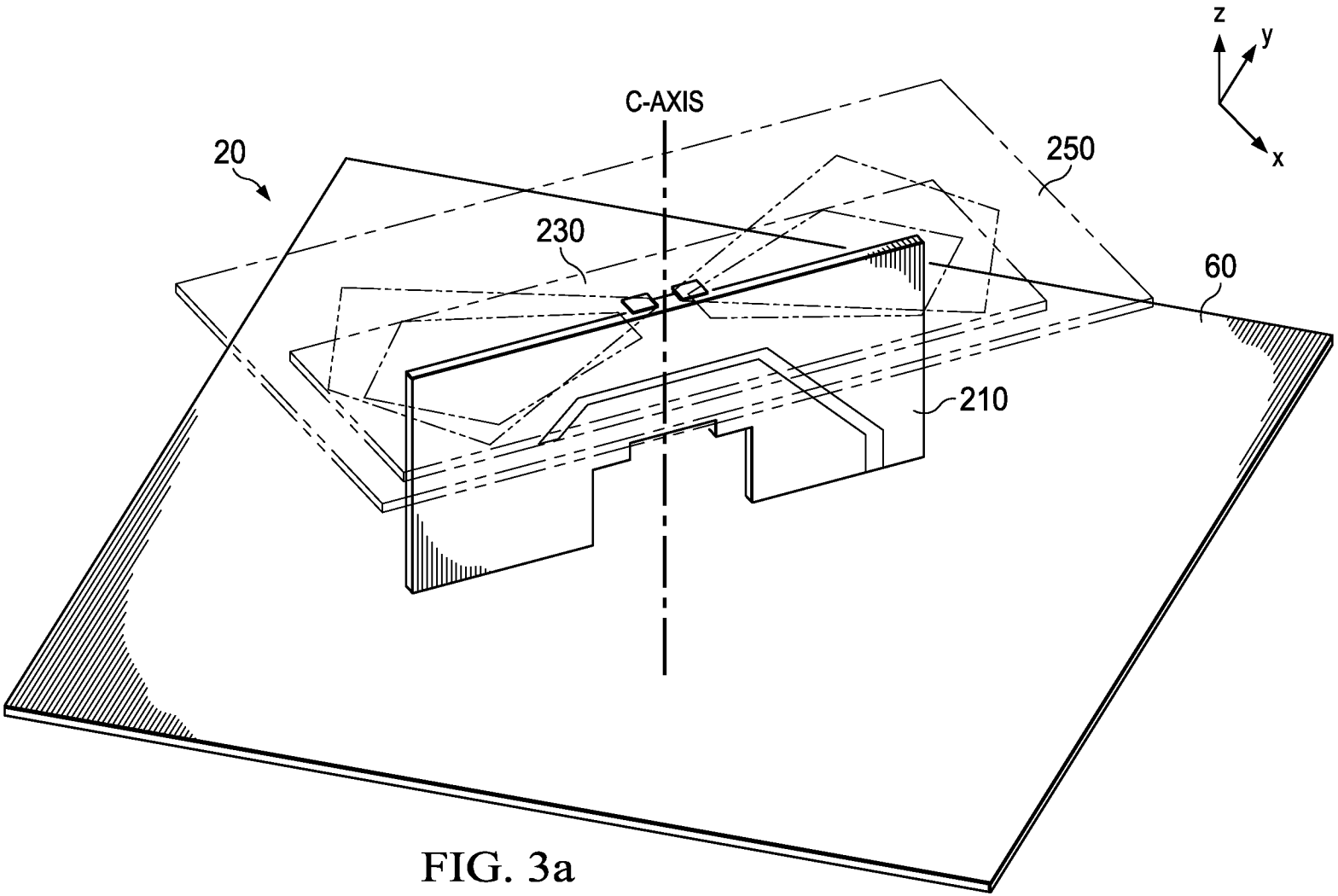
FIG. 3*a* shows a three dimensional view of a dipole antenna element according to an embodiment.

FIG. 3*a* shows a three dimensional view of the dipole element 20. The dipole element 20 comprises three dielectric substrates 210, 230, 250 (e.g., circuit boards). The dipole element 20 comprises a vertical substrate 210, a first horizontal substrate 230 and a second horizontal substrate 250. The vertical substrate 210 may be orthogonally arranged to a plane of the antenna reflector element 60 while the first and second horizontal substrates 230, 250 may be arranged parallel to the antenna reflector element 60. The vertical substrate 210 may be placed with a side surface on the antenna reflector element 60.

Each dipole element 20, 30 may comprise a micro-strip balun integrated in the dielectric substrate is electrically connected to the dipole probes of the lower dipole and the upper dipole. The lower dipole may excite the upper dipole.

Figure 3B:
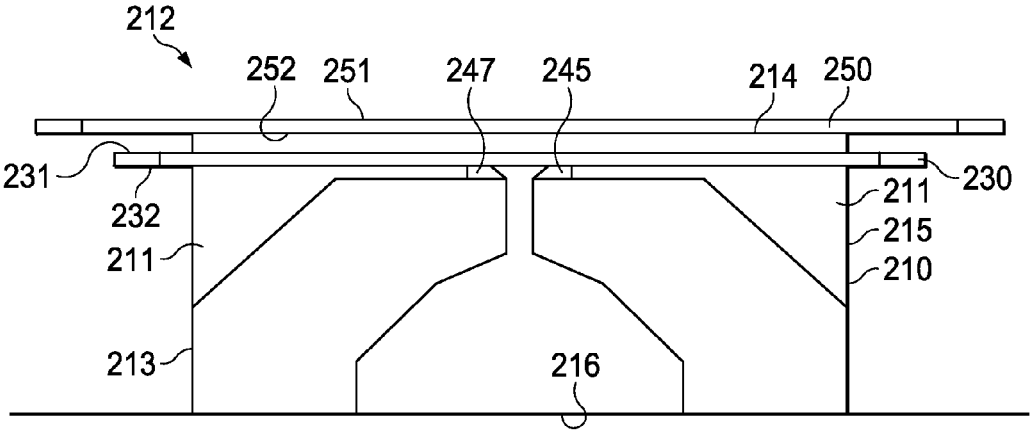
FIG. 3*b* shows a cross sectional view of the dipole antenna element according to an embodiment.
Figure 3C:
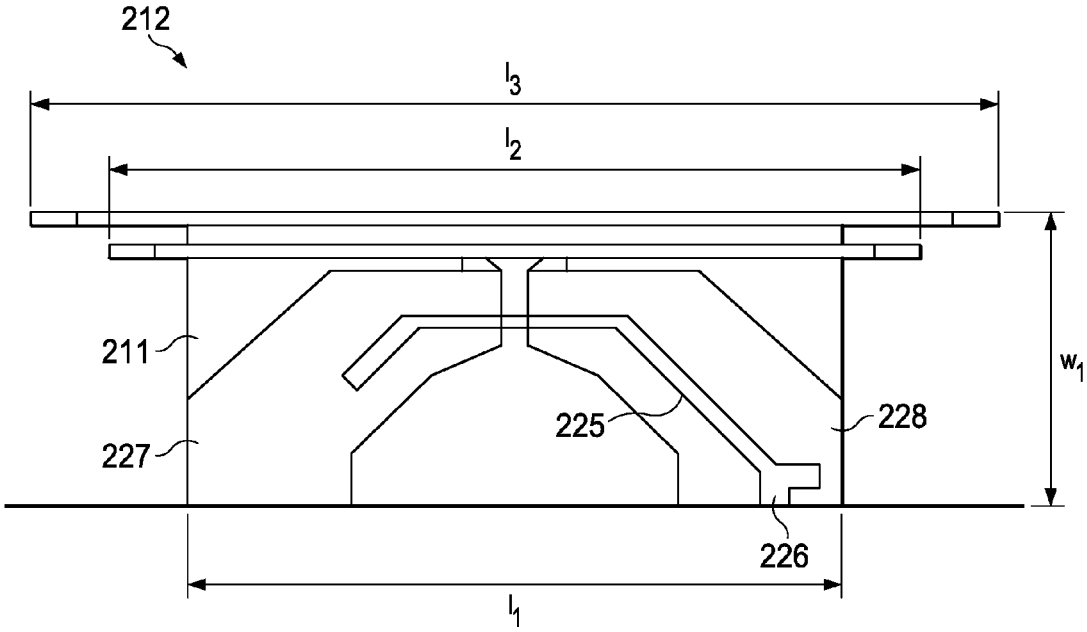
FIG. 3*c* shows a cross sectional view of the dipole antenna element according to an embodiment.
Figure 3D:
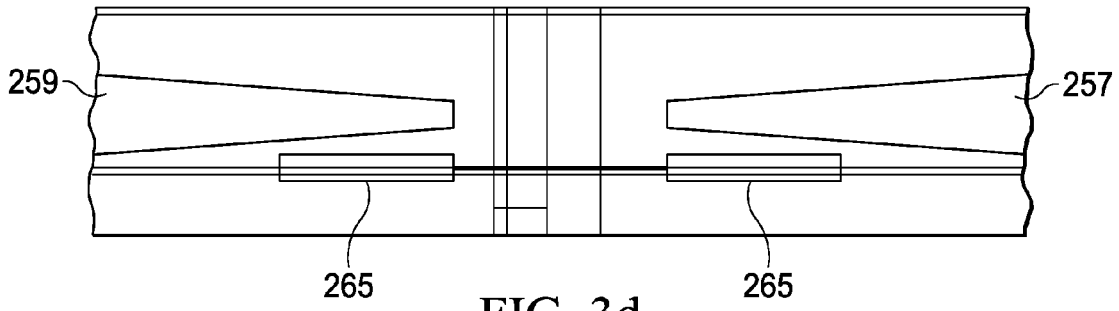
FIG. 3*d* shows a detail of the top substrate according to an embodiment.
Figure 3E:
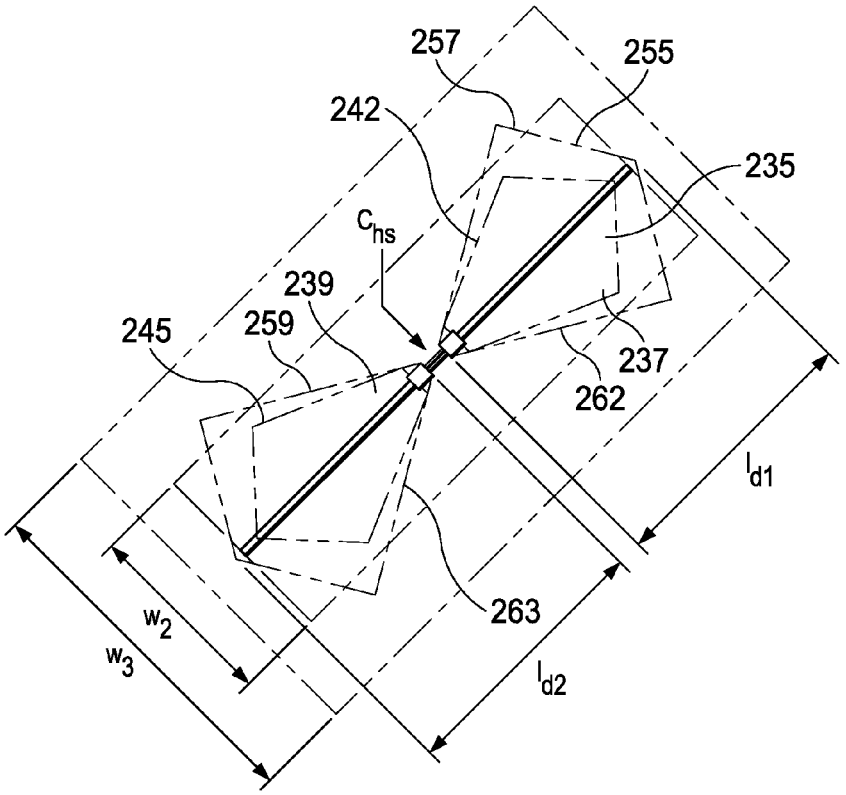
FIG. 3*e* shows a top view of the dipole antenna element according to an embodiment.

Referring now to FIGS. 3*b* and 3*c*, the vertical substrate 210 comprises a first main surface 211, a second main surface 212 and side surfaces 213-216 connecting the first main surface 211 and the second main surface 212. The vertical substrate 210 may be disposed on the antenna reflector element 60 such that the antenna reflector element 60 is mechanically connected to a side surface 216 of the substrate 210.

The vertical substrate 210 may comprise a conductive line 225 supported by or printed on the first main surface 211. The conductive line 225 may be connected to a feed point 226. The feed point 226 is electrically isolated from the antenna reflector element 60. The vertical substrate 210 may further comprise conductive plates 227, 228 supported by or printed on the second main surface 212. The conductive plates 227, 228 may be electrically connected to the antenna reflector element 60 (e.g., soldered). The conductive plates 227, 228 are not connected to each other and spaced apart by a gap. The gap is necessary in order to excite a differential impedance at this point. The exact differential impedance is sensitive to the dimension of the gap. The vertical substrate 210 with the gap provides a balanced feed connection to the lower dipole probe 235. The balanced feed connection may be a balanced feed gap of about 90Ω. The vertical substrate 210 with the printed patterns 225, 227, 228 may form a balun with an unbalanced 5052 feed point 226.

The vertical substrate 210 may comprise a length $l_1$ between 40 mm and 80 mm or a length of about 60 mm (+/−10%) and a width $w_1$ between 20 mm and 40 mm or a width of about 30 mm (+/−10%). The conductive line 225, the feed point 226 and the conductive plates 227, 228 may comprise the same conductive materials such as copper or a copper alloy, or alternatively, aluminum or an aluminum alloy. In some embodiments the materials for the line 225 and the plates 227, 228 may be different. The conductive plates 227, 228 may be a balun ground.

The first horizontal substrate 230 may be a lower dipole element. The first horizontal substrate 230 may be printed only on one of its main surfaces 231, 232 (see FIG. 3*b*) with a conductive material pattern 235, e.g., a lower dipole probe (see FIG. 3*e*). The lower dipole probe 235 may be situated on the first main surface (e.g., upper main surface) 231, or alternatively, on the second main surface (e.g., lower main surface) 232 (see FIG. 3*b*). The lower dipole probe 235 may comprise two conductive plates 237, 239 having identical forms of a regular polygon such as a rhombus or diamond. The rhombus may not be symmetrical rhombus but may comprise longer sides 242, 243 closer to a central point $C_{hs}$. Alternatively, the plates 237, 239 may comprise a curvilinear shape or may be a polygon with narrow features near the central point $C_{hs}$ and broader or wider features at the tips to provide good bandwidth and radiation pattern. The narrowing near the central point is advisable so that the two conductive plates 237, 239 of the lower dipole probe 235 can approach the balun gap differential feed point. This facilitates conductive connection to the lower dipole patch. The five vertices of each plate 237, 239 can be sharp or round. The plates may have more or less than five vertices. In some embodiment, the plates 237, 239 may not be rectangular. Each of the plates 237, 239 may be electrically connected to the connection 245, 247, which may be through-vias or edge connection elements. The electrical connections 245, 247 may be established by soldering the conductive pattern of the first horizontal substrate 230 and the vertical substrate 210. The plates 237, 239 of the lower dipole probe 235 are connected via the electrical connections 245, 247 to the balanced feed point of the balun (gap between conductor plates 227, 228). The gap of the conductor plates 227, 228 may be the same as the gap between the conductors 245, 247. This balance feed point is configured to be excited by the balun input port 226.

The first horizontal substrate 230 may comprise a length $l_2$ between 60 mm and 100 mm or a length $l_2$ of about 80 mm (+/−10%) and a width $w_2$ between 20 mm and 40 mm or a width $w_2$ of about 30 mm (+/−10%). Each conductive plate 237, 239 of the lower dipole probe 235 may comprise a length $l_{d1}$ of about λ/4. About λ/4 means λ/4+/−10%, or alternatively, λ/4+/−5%, or even λ/4+/−2%. The first horizontal substrate 230 may be longer than the first vertical substrate 210. The conductive material pattern may comprise a conductive material such as copper or a copper alloy, or alternatively, aluminum or an aluminum alloy.

The second horizontal substrate 250 may be an upper dipole element. The second horizontal substrate 250 may be printed only on one of its main surfaces 251, 252 (see FIG. 3*b*) with a conductive material pattern 255, e.g., an upper dipole probe (see FIG. 3*e*). The upper dipole probe 255 may be situated on the first main surface (e.g., upper main surface) 251. The upper dipole probe 255 may comprise two conductive plates 257, 259 having identical forms of a regular polygon such as a rhombus or diamond. The rhombus may not be symmetrical rhombus but may comprise longer sides 262, 263 closer to a central point $C_{hs}$. Alternatively, the plates 257, 259 comprise a curvilinear shape or may be polygons as described above with respect to the plates 237, 239. The plates 257, 259 of the upper dipole probe 255 may approach the central point $C_{hs}$ so that the small capacitance can be placed there with a small inductance connection. In some embodiment, the plates 257, 259 may not be rectangular. Each of the plates 257, 259 may be capacitively (or in some embodiments inductively) connected to the capacitor 265. The capacitor 265 may be located on the lower (second) main surface 252. The capacitor 265 may be a parallel plate capacitor. The capacitor 265 creates a capacitive connection between the two plates 257, 259. There is no capacitive connection or capacitor for the lower dipole probe 235. The capacitance 265 has the effect of broadening the frequency band of the dipole input impedance match.

The second horizontal substrate 250 may comprise a length $l_2$ between 80 mm and 120 mm or a length $l_2$ of about 100 mm (+/−10%) and a width $w_2$ between 30 mm and 50 mm or a width $w_2$ of about 40 mm (+/−10%). Each conductive plate 257, 259 of the upper dipole probe 235 may comprise a length $l_{d2}$ of about λ/4. The total length, end to end, of the upper dipole probe 255 is approximately λ/2 near the lower end of the frequency band while the total length, end to end, of the smaller lower dipole probe 235 is approximately λ/2 near the upper end of the frequency band. Such a configuration helps to yield a high bandwidth in some embodiments.

In some embodiments the total length of the upper dipole may be approximately 6.25 cm and the total length of the lower dipole may be approximately 6 cm for the lower dipole (for WiFi 2.4 GHz-2.5 GHz). The height may be approximately 2 cm (λ/6).

The second horizontal substrate 250 may be longer and wider than the first horizontal substrate 230. The conductive material pattern may comprise a conductive material such as copper or a copper alloy, or alternatively, aluminum or an aluminum alloy.

In some embodiments, there is no conductive connection between the first dipole element 235 and the second dipole element 255. The distance between the lower dipole element 230 to the upper dipole element 250 may affect the magnitude of the coupling. The distance may be about 1 mm to 5 mm, or alternatively, about 2 mm to 3 mm.

Figure 4B:
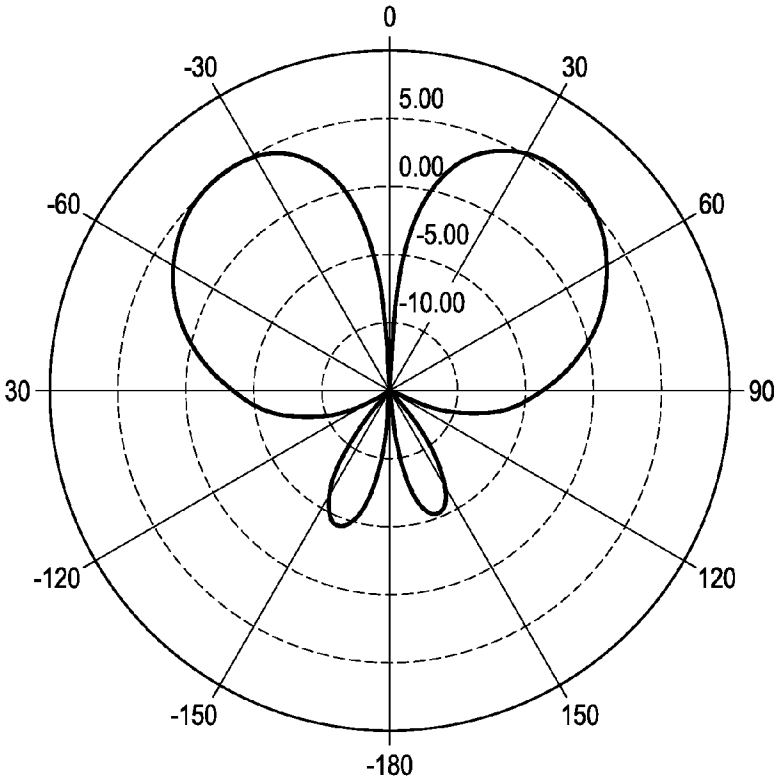
FIGS. 4*a* and 4*b* show radiation pattern of the monopole element and the dipole element.
Figure 4A:
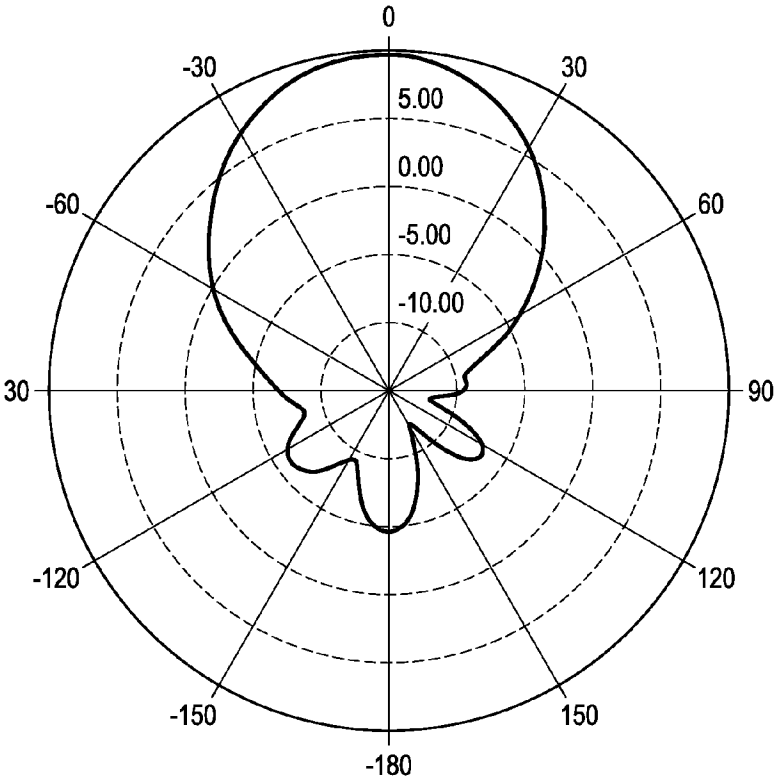

FIG. 4*a* shows the radiation pattern of the dipole elements 20, 30 and FIG. 4*b* shows the radiation pattern of the monopole 50.

FIGS. 5*a*-5*d* show electrical performance plots for an embodiment of the compact three pole antenna element 10 optimized for signals in the 1.7 GHz-2.7 GHz band. FIG. 5*a* shows that the return loss at the input ports S11, S22 and S33 are lower than −10 dB and that the coupling coefficients S13, S32 and S21 are lower than −30 dB.

FIG. 5*b* shows the co-polarization radiation and the cross-polarization radiation of the first dipole element 20 (integrated in the compact antenna element 10) at 1.7 GHz, 2.2 GHz and 2.7 GHz while FIG. 5*c* shows the co-polarization radiation and the cross-polarization radiation of the second dipole element 30 for the same frequencies. As can be seen from the plots, the cross-polarization pattern for the first and second dipole elements 20, 30 are lower than −15 dB. Both dipole elements show the same good performance in the whole frequency range: low side lobes (lower than −20 dB), low back radiation and small variation of the beam-width within the frequency range. FIG. 5*d* shows the co-polarization radiation and the cross-polarization radiation of the monopole element 50 (integrated in compact antenna element 10) at 1.7 GHz, 2.2 GHz and 2.7 GHz. Similar to the other elements, the monopole element 50 shows a very good electrical performance. Cross-polarization gains are lower than −22 dB while co-polarization maximum gain is about 5 dB.

Figure 6:
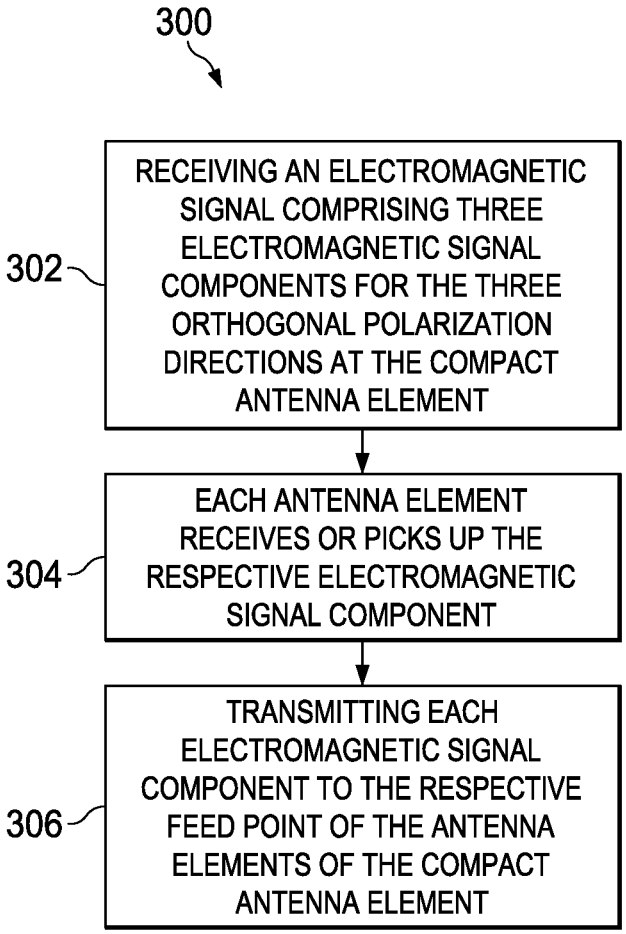
FIG. 6 shows a method for operating the compact antenna element.

FIG. 6 shows a method 300 for operating the compact antenna element. The compact antenna element comprising two dipole elements collocated with a monopole element receives an electromagnetic signal at step 302. The electromagnetic signal may comprise an electromagnetic signal component for each of the orthogonal polarization directions. The vertical polarized monopole element receives or picks up a (first) electromagnetic signal component in its polarization direction, the first polarized dipole element receives or picks up a (second) electromagnetic signal component in its polarization direction and the second polarized dipole element receives or picks up a (third) electromagnetic signal component in its direction (step 304). The compact antenna element transmits these electromagnetic signal components to the respective feed points of the compact antenna elements. For example, the first electromagnetic signal component is transmitted to the feed point of the monopole element, the second electromagnetic signal component is transmitted to the feed point of the first dipole element and the third electromagnetic signal component is transmitted to the feed point of the second dipole element.

Embodiments of the invention may include an antenna array comprising a plurality of compact antenna elements. For example, the antenna array may be implemented as a MIMO antenna.

Embodiments of the antenna elements may be used for frequency bands between 300 MHz and 30 GHz. For example, the antenna can be operated in GSM, UMTS or LTE wireless systems. The applicable frequency bands may be 790 MHz-860 MHz, 1.7 GHz-1.9 GHz, and 2.5 GHz-2.7 GHz. Further embodiments of the antenna elements may be used for 2.4 GHz-2.5 GHz and 5 GHz-6 GHz (WiFi band). Alternatively, embodiments of the antenna element may be used in the 60 GHz band, e.g., 57 GHz-66 GHz, in the E-band (e.g., 71 GHz-76 GHz and 81 GHz-86 GHz) and in the 90 GHz band, e.g., 92 GHz-95 GHz.

Embodiment of the invention may be applied to radar system such as automotive radar or telecommunication applications such as transceiver applications in base stations or user equipment (e.g., hand held devices).

Embodiments of the invention include an antenna element comprising a first dipole element configured to emit or receive electromagnetic signals in a first polarization direction, a second dipole element configured to emit or receive electromagnetic signals in a second polarization direction, a monopole element configured to emit or receive electromagnetic signals in a third polarization direction and an antenna reflector element, wherein the first dipole element, the second dipole element and the monopole element are collocated on the antenna reflector element, and wherein the first polarization direction, the second polarization direction and the third polarization direction are all different.

Embodiments provide that the antenna element comprises a height of about λ/6, wherein λ is a wavelength of an electromagnetic signal.

Further embodiments provide that the first dipole element is rotate about 45° relative to a main direction of the monopole element, and wherein the second dipole element is rotated about −45° relative to the main direction of the monopole element.

Embodiments provide that the first dipole element and the second dipole element are arranged orthogonal to each other as a crossed dual dipole element.

Embodiments provide that the crossed dual dipole element is symmetric.

Embodiments provide that the monopole element is symmetric and comprises a height of about λ/6.

Embodiments provide that the first polarization direction, the second polarization direction and the third polarization direction are each orthogonal to each other.

Embodiments provide that the monopole element is a folded monopole element.

Some embodiment include a method for operating the antenna element, the method comprising: receiving a first electromagnetic signal component at the monopole element, receiving a second electromagnetic signal component at the first dipole element, and receiving a third electromagnetic signal component at the second dipole element.

Embodiments of the invention include an antenna element comprising: an antenna reflector element, a monopole element disposed on the antenna reflector element in a first direction, a first dipole element disposed on the antenna reflector element in a second direction, and a second dipole element disposed on the antenna reflector element in a third direction, wherein the second direction is arranged in about a +45° angle to the first direction, wherein the third direction is arranged in about a −45° angle to the first direction, and wherein the monopole element, the first dipole element and the second dipole element are arranged around a central axis, the central axis being orthogonal to the antenna reflector element.

Embodiments provide that the antenna reflector is a conductive plate, and that the monopole element comprises two dielectric substrates each having two main surfaces and side surfaces connecting the two main surfaces, the dielectric substrates being arranged orthogonal to each other, a conductive pattern being printed on each main surface, and wherein each substrate is disposed with a side surface on the antenna reflector element.

Embodiments provide that only one of the dielectric substrates comprises an input port while the other of the dielectric substrates does not.

Further embodiments provide that the monopole element has a height of about λ/6.5, wherein λ is a wavelength of an electromagnetic signal.

Further embodiments provide that the first dipole element and the second dipole element each comprises three dielectric substrates each having two main surfaces and side surfaces connecting the two main surfaces, a first dielectric substrate being disposed with a bottom side surface on the antenna reflector element, a second dielectric substrate and a third dielectric substrate being arranged parallel to the antenna reflector element, and wherein the third dielectric substrate is arranged on a top side surface of the first dielectric substrate.

Embodiments provide that each dipole element comprises a lower dipole probe arranged on the second dielectric substrate, and upper dipole probe arranged on the third dielectric substrate.

Embodiments provide that the upper dipole probe is larger than the lower dipole probe and that each dipole element comprises a balun.

Embodiments provide a method for operating the antenna element, the method comprising: receiving a first electromagnetic signal component at the monopole element, receiving a second electromagnetic signal component at the first dipole element and receiving a third electromagnetic signal component at the second dipole element.

Embodiments of the invention include a system comprising an antenna element. The antenna element includes a first dipole element configured to emit or receive electromagnetic signals in a first polarization direction, a second dipole element configured to emit or receive electromagnetic signals in a second polarization direction, a monopole element configured to emit or receive electromagnetic signals in a third polarization direction, and an antenna reflector element, wherein the first dipole element, the second dipole element and the monopole element are collocated on the antenna reflector element, and wherein the first polarization direction, the second polarization direction and the third polarization direction are all different.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An antenna element comprising:

a first dipole element configured to emit or receive electromagnetic signals in a first polarization direction;

a second dipole element configured to emit or receive electromagnetic signals in a second polarization direction;

a monopole element configured to emit or receive electromagnetic signals in a third polarization direction; and an antenna reflector element, wherein the first dipole element, the second dipole element and the monopole element are collocated on the antenna reflector element, and wherein the first polarization direction, the second polarization direction and the third polarization direction are all different.

2. The antenna element according to claim 1, wherein the antenna element comprises a height of about λ/6, wherein λ is a wavelength of an electromagnetic signal.

3. The antenna element according to claim 1, wherein the first dipole element is rotate about 45° relative to a main direction of the monopole element, and wherein the second dipole element is rotated about −45° relative to the main direction of the monopole element.

4. The antenna element according to claim 1, wherein the first dipole element and the second dipole element are arranged orthogonal to each other as a crossed dual dipole element.

5. The antenna element according to claim 4, wherein the crossed dual dipole element is symmetric.

6. The antenna element according to claim 1, wherein the monopole element is symmetric and comprises a height of about λ/6.

7. The antenna element according to claim 1, wherein the first polarization direction, the second polarization direction and the third polarization direction are each orthogonal to each other.

8. The antenna element according to claim 1, wherein the monopole element is a folded monopole element.

9. A method for communicating an electromagnetic signal, the method comprising:

receiving or emitting, by a monopole element, a first electromagnetic signal component in a first polarization direction;

receiving or emitting, by a first dipole element, a second electromagnetic signal component in a second polarization direction; and receiving or emitting, by a second dipole element, a third electromagnetic signal component in a third polarization direction, wherein the first dipole element, the second dipole element and the monopole element are collocated on an antenna reflector element, and wherein the first polarization direction, the second polarization direction and the third polarization direction are all different.

10. The method according to claim 9, wherein the first dipole element is rotated relative to the monopole element by about a +45° angle, and wherein the second dipole element is rotated relative to the monopole element by about a −45° angle.

11. The method according to claim 9, wherein the first polarization direction, the second polarization direction and the third polarization direction are each orthogonal to each other.

12. An antenna element comprising:

an antenna reflector element;

a monopole element disposed on the antenna reflector element in a first direction;

a first dipole element disposed on the antenna reflector element in a second direction; and a second dipole element disposed on the antenna reflector element in a third direction, wherein the second direction is arranged in about a +45° angle to the first direction, wherein the third direction is arranged in about a −45° angle to the first direction, and wherein the monopole element, the first dipole element and the second dipole element are arranged around a central axis, the central axis being orthogonal to the antenna reflector element.

13. The antenna element according to claim 12, wherein the antenna reflector element is a conductive plate.

14. The antenna element according to claim 12, wherein the monopole element comprises two dielectric substrates each having two main surfaces and side surfaces connecting the two main surfaces, the dielectric substrates being arranged orthogonal to each other, a conductive pattern being printed on each main surface, and wherein each substrate is disposed with a side surface on the antenna reflector element.

15. The antenna element according to claim 14, wherein only one of the dielectric substrates comprises an input port while the other of the dielectric substrates does not.

16. The antenna element according to claim 12, wherein the monopole element has a height of about $\lambda/6.5$, wherein $\lambda$ is a wavelength of an electromagnetic signal.

17. The antenna element according to claim 12, wherein the first dipole element and the second dipole element each comprises three dielectric substrates each having two main surfaces and side surfaces connecting the two main surfaces, a first dielectric substrate being disposed with a bottom side surface on the antenna reflector element, a second dielectric substrate and a third dielectric substrate being arranged parallel to the antenna reflector element, and wherein the third dielectric substrate is arranged on a top side surface of the first dielectric substrate.

18. The antenna element according to claim 17, wherein each dipole element comprises a lower dipole probe arranged on the second dielectric substrate, and upper dipole probe arranged on the third dielectric substrate.

19. The antenna element according to claim 18, wherein the upper dipole probe is larger than the lower dipole probe.

20. The antenna element according to claim 17, wherein each dipole element comprises a balun.

21. A method for communicating an electromagnetic signal from and to an antenna element, wherein the antenna element comprises an antenna reflector element, a monopole element disposed on the antenna reflector element in a first direction, a first dipole element disposed on the antenna reflector element in a second direction and a second dipole element disposed on the antenna reflector element in a third direction, wherein the second direction is arranged in about a +45° angle to the first direction, wherein the third direction is arranged in about a −45° angle to the first direction, and wherein the monopole element, the first dipole element and the second dipole element are arranged around a central axis, the central axis being orthogonal to the antenna reflector element, the method comprising:

receiving or emitting, by the monopole element, a first electromagnetic signal component;

receiving or emitting, by the first dipole element, a second electromagnetic signal component; and receiving or emitting, by a second dipole element, a third electromagnetic signal component.

* * * * *